US009640924B2

(12) United States Patent
Stanislaw et al.

(10) Patent No.: US 9,640,924 B2
(45) Date of Patent: May 2, 2017

(54) COMMUNICATION PLUG

(71) Applicant: Panduit Corp., Tinley Park, IL (US)

(72) Inventors: David C. Stanislaw, Cicero, IL (US); Michael B. Verbeek, Crown Point, IN (US); Satish I. Patel, Roselle, IL (US); Jason O'Young, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 107 days.

(21) Appl. No.: 14/716,540

(22) Filed: May 19, 2015

(65) Prior Publication Data

US 2015/0340823 A1 Nov. 26, 2015

Related U.S. Application Data

(60) Provisional application No. 62/001,747, filed on May 22, 2014.

(51) Int. Cl.

| | |
|---|---|
| ***H01R 4/24*** | (2006.01) |
| ***H01R 24/64*** | (2011.01) |
| ***H01R 43/01*** | (2006.01) |
| ***H01R 43/048*** | (2006.01) |
| ***H01R 13/41*** | (2006.01) |
| *H01R 107/00* | (2006.01) |

(52) U.S. Cl.

CPC ..... *H01R 24/64* (2013.01); *H01R 4/242* (2013.01); *H01R 13/41* (2013.01); *H01R 43/01* (2013.01); *H01R 43/048* (2013.01); *H01R 4/2429* (2013.01); *H01R 2107/00* (2013.01); *Y10T 29/49192* (2015.01)

(58) Field of Classification Search

CPC ..... H01R 4/2404; H01R 4/24; H01R 12/675; H01R 13/58; H01R 12/67; H01R 13/6463; H01R 4/2429; H01R 43/01; H01R 13/6589; H01R 4/2416

USPC ..... 439/418, 395, 344

See application file for complete search history.

(56) References Cited

U.S. PATENT DOCUMENTS

| | | | |
|---|---|---|---|
| 4,054,350 | A | 10/1977 | Hardesty |
| 4,089,580 | A | 5/1978 | Huffnagle et al. |
| 4,148,539 | A | 4/1979 | Hardesty |
| 4,160,575 | A | 7/1979 | Schraut |
| 4,211,462 | A | 7/1980 | Wolfthal |
| 4,412,715 | A | 11/1983 | Bogese, II |
| 4,431,246 | A | 2/1984 | Vaden |
| 4,501,464 | A | 2/1985 | Bogese, II |
| 4,506,944 | A | 3/1985 | Brennan et al. |
| 4,516,825 | A | 5/1985 | Brennan et al. |
| 4,577,921 | A | 3/1986 | Bogese, II |
| 4,601,530 | A | 7/1986 | Coldren et al. |
| 4,607,905 | A | 8/1986 | Vaden |
| 4,613,196 | A | 9/1986 | Foerster |
| 4,650,269 | A | 3/1987 | Denkmann et al. |
| 4,653,837 | A | 3/1987 | Phillipson et al. |
| 4,679,878 | A | 7/1987 | Volk |
| 4,713,023 | A | 12/1987 | Bixler et al. |
| 4,715,825 | A | 12/1987 | Mouissie et al. |

(Continued)

*Primary Examiner* — Xuong Chung Trans

(74) *Attorney, Agent, or Firm* — Christopher S. Clancy; James H. Williams; Yuri Astvatsaturov

(57) ABSTRACT

In an embodiment, the present invention is a communication plug that includes a plug housing with a plurality of plug contact slots and at least one plug contact with at least two tines. The at least one plug contact is positioned in one of the plug contact slots, the one of the plug contact slots having a bridge positioned between the at least two tines.

7 Claims, 12 Drawing Sheets

(56) References Cited

U.S. PATENT DOCUMENTS 4,767,355 A 8/1988 Phillipson et al.
4,781,623 A 11/1988 Philippson et al.
4,874,330 A 10/1989 Bogese, II et al.
4,889,503 A 12/1989 Philippson et al.
4,909,755 A 3/1990 Chen
4,950,176 A 8/1990 Cocco et al.
5,059,140 A 10/1991 Philippson et al.
5,194,014 A 3/1993 McClune et al.
5,226,835 A 7/1993 Baker, III et al.
5,246,381 A 9/1993 Tashiro et al.
5,284,447 A 2/1994 Kristiansen
5,382,182 A 1/1995 Shen et al.
5,571,035 A 11/1996 Ferrill
5,593,314 A 1/1997 Lincoln
5,605,469 A 2/1997 Wellinsky et al.
5,692,925 A 12/1997 Bogese, II
5,727,962 A 3/1998 Caveney
5,727,967 A 3/1998 Chen
5,896,480 A 4/1999 Scharf et al.
5,899,770 A 5/1999 Ezawa
5,951,330 A 9/1999 Reichard, Jr. et al.
5,971,812 A 10/1999 Martin
5,975,936 A 11/1999 Lin et al.
5,989,071 A 11/1999 Larsen et al.
5,993,236 A 11/1999 Jenner et al.
6,010,353 A 1/2000 Ensz et al.
6,017,240 A 1/2000 Belopolsky et al.
6,074,256 A 6/2000 Arnett
6,080,007 A 6/2000 Dupuis et al.
6,099,345 A 8/2000 Milner et al.
6,109,943 A 8/2000 Arnett
6,116,943 A 9/2000 Ferrill et al.
6,139,343 A 10/2000 Arnett
6,149,454 A 11/2000 Watanabe
6,193,542 B1 2/2001 Marowsky et al.
6,206,734 B1 3/2001 Liu
6,224,427 B1 5/2001 Goodrich
6,238,231 B1 5/2001 Chapman et al.
6,250,949 B1 6/2001 Lin
6,250,951 B1 6/2001 Milner et al.
6,276,954 B1 8/2001 Arnett et al.
6,280,232 B1 8/2001 Beecher et al.
6,312,292 B2 11/2001 Liu
6,319,048 B1 11/2001 Aekins et al.
6,354,865 B1 3/2002 Bogese
6,358,092 B1 3/2002 Siemon et al.
6,364,715 B1 4/2002 Liu et al.
6,402,559 B1 6/2002 Marowsky et al.
6,409,535 B1 6/2002 Marowsky et al.
6,439,920 B1 8/2002 Chen
6,454,590 B1 9/2002 Goodrich et al.
6,524,128 B2 2/2003 Marowsky et al.
6,561,838 B1 5/2003 Blichfeldt
6,579,116 B2 6/2003 Brennan et al.
6,663,436 B1 12/2003 Arnett et al.
6,736,681 B2 5/2004 Arnett
6,811,445 B2 11/2004 Caveney et al.
6,932,641 B1 8/2005 Liao
6,962,503 B2 11/2005 Aekins
7,018,241 B2 3/2006 Caveney et al.
7,101,212 B1 9/2006 Larkin
7,134,904 B2 11/2006 Bergner et al.
7,168,994 B2 1/2007 Caveney et al.
7,223,112 B2 5/2007 AbuGhazaleh et al.
7,294,012 B2 11/2007 AbuGhazaleh et al.
7,374,458 B2 5/2008 Caveney et al.
7,425,159 B2 9/2008 Lin
7,435,126 B1 10/2008 Larkin
7,438,583 B2 10/2008 AbuGhazaleh et al.
7,556,536 B2 7/2009 Caveney et al.
7,572,140 B2 8/2009 Szelag et al.
7,661,980 B2 2/2010 Dietrich et al.
7,753,717 B2 7/2010 Belopolsky et al.
7,780,480 B2 8/2010 Caveney
7,972,183 B1 7/2011 Lin
8,043,124 B2 10/2011 Caveney et al.
8,197,286 B2 6/2012 Larsen et al.
8,414,319 B2 4/2013 Patel et al.
2001/0005650 A1 6/2001 Liu
2002/0137385 A1 9/2002 Goodrich et al.
2003/0199192 A1 10/2003 Caveney et al.
2005/0037672 A1 2/2005 Caveney et al.
2005/0106929 A1 5/2005 Meckley et al.
2005/0153603 A1 7/2005 AbuGhazaleh et al.
2006/0134996 A1 6/2006 Caveney et al.
2006/0199414 A1 9/2006 Larkin
2007/0105453 A1 5/2007 Caveney et al.
2007/0293097 A1 12/2007 Martin et al.
2008/0220658 A1 9/2008 Caveney et al.
2009/0104822 A1 4/2009 Dietrich et al.
2009/0227151 A1 9/2009 Caveney
2009/0269973 A1 10/2009 Caveney et al.
2010/0144209 A1 6/2010 Hetzer et al.
2010/0317237 A1 12/2010 Caveney
2012/0094525 A1 4/2012 Maranto et al.
2012/0100744 A1 4/2012 Bolouri-Saransar et al.
2012/0205153 A1 8/2012 Larson et al.
2012/0244752 A1 9/2012 Patel et al.
2012/0269484 A1 10/2012 Peto
2013/0012043 A1 1/2013 Patel et al.
2013/0052860 A1 2/2013 Caveney et al.
2013/0210289 A1 8/2013 Schumacher et al.
2013/0280962 A1 10/2013 Fransen

COMMUNICATION PLUG

CROSS-REFERENCE TO RELATED APPLICATIONS

This application claims the benefit of U.S. Provisional Patent Application No. 62/001,747, filed on May 22, 2014, which is incorporated herein by reference in its entirety.

FIELD OF INVENTION

Embodiment of the present invention generally relate to the field of network communication, and more particularly, to communication connectors and methods of manufacture and use thereof.

BACKGROUND

Communication connectors are essential to today's networking environments. These connectors enable the interconnectivity between wide varieties of active and/or passive components. One particularly popular form of network connectivity used in conjunction with copper cabling is the RJ45 form factor. An RJ45 communication channel can include an RJ45 jack, with a communication cable connected thereto, mated with a corresponding RJ45 plug, also having another communication cable connected thereto. When the plug and jack are mated, electronic data can be transmitted therethrough. For reliable data transmission continuity must be maintained from the jack cable through the jack cable contacts and remainder of the jack, jack/plug interface, plug contacts and plug cable.

One type of plug contacts are insulation piercing contacts (IPCs) which pierce the insulation of the plug cable with typically two, or more, IPC piercing tines when the plug is terminated to the cable. The tips of the two tines are displaced longitudinally from each other, and also slightly displaced with respect to each other in a transverse direction. Ideally, the two tines pierce the respective conductor insulation so that they make contact on either side of the metallic conductor, and also trap the metallic conductor between the tines to ensure reliable IPC to conductor contact, with reliability being maintained in the presence of shock, vibration, plug/jack mating cycles and other loading. Some IPCs may have relatively short piercing tine lengths which can be relatively stiff, and this stiffness can result in problems during the termination of the plug. For example, the IPC and the cable conductor can be forced to twist away from each other during termination resulting in the cable conductor contacting the tines of the corresponding IPC primarily at their corners of the IPC tine. The twist of the IPCs can also deform the plug housing comb and reduce clearance critical for jack contact free movement. In another example, the increased crimping forces which may be required during termination can force the conductor to the edge of the conductor tunnel and simultaneously extrude away the conductor insulation at the tunnel edge.

A slotted IPC design which effectively increases the tine length can reduce the stiffness of the tines of an IPC. However, such designs have their own challenges. For example, the increased length and slotting of the tines can result in a gap therebetween. When IPCs with relatively long tines are stitched into a plug housing, the slot gap between the IPC's tines allows each tine to deform towards the slot and the interference fit critical for IPC retention into the plug housing may thereby be eliminated. This can result in the IPCs coming loose from the plug housing prior to termination. Furthermore, the extended length of the tines may structurally weaken the IPC. Thus, there is a need for improved communication plugs, various components thereof, and methods associated therewith.

SUMMARY

Accordingly, at least some embodiments of the present invention are directed towards communication plugs, various components thereof, and methods associated therewith.

In an embodiment, the present invention is a communication plug that includes a plug housing with a plurality of plug contact slots and at least one plug contact with at least two tines. The at least one plug contact is positioned in one of the plug contact slots, the one of the plug contact slots having a bridge positioned between the at least two tines.

Another embodiment of the present invention includes a communication plug having a plug housing with a plurality of plug contact slots. The plug further has at least one plug contact with at least two tines that are positioned in one of the plug contact slots. A support element is positioned between the at least two tines.

Another embodiment of the present invention includes a communication system having a communication equipment connected to a patch cord. The patch cord includes a communication cable connected to a communication plug, where the communication plug has a plug housing with a plurality of plug contact slots. The plug further has at least one plug contact with at least two tines that are positioned in one of the plug contact slots. A support element is positioned between the at least two tines.

In another embodiment, the present invention is a method of terminating a communication plug to a communication cable having signal conductors, the method includes the steps of (1) providing a plug housing with conductor channels for receiving the signal conductors, the plug housing having plug contact slots with a bridge for receiving plug contacts; (2) providing the plug contacts with insulation piercing contacts for making contact with the signal conductors, the plug contacts having at least two tines; (3) positioning the plug contacts in respective the plug contact slots so that the bridge is positioned between the at least two tines; and (4) crimping the plug contacts to achieve electrical contact between the insulation piercing contacts and respective signal conductors.

In yet another embodiment, the present invention is a method for manufacturing a communication plug, the method including the steps of: (1) providing a plug housing having a plurality of plug contact slots, each of the plug contact slots having a bridge; and (2) partially inserting a plug contact having at least two tines into each of the plurality of plug contact slots such that the bridge is positioned between the at least two tines.

In yet another embodiment, the present invention includes communication plug with a plurality of plug contacts where each of the plug contacts has at least two tines. The communication plug further includes a plug housing with a plurality of plug contact slots, where each of the plug contacts are positioned in one of said plug contact slots. The plug housing further includes a support element positioned between the at least two tines.

These and other features, aspects, and advantages of the present invention will become better understood with reference to the following drawings, description, and any claims that may follow.

DETAILED DESCRIPTION

Figure 1:
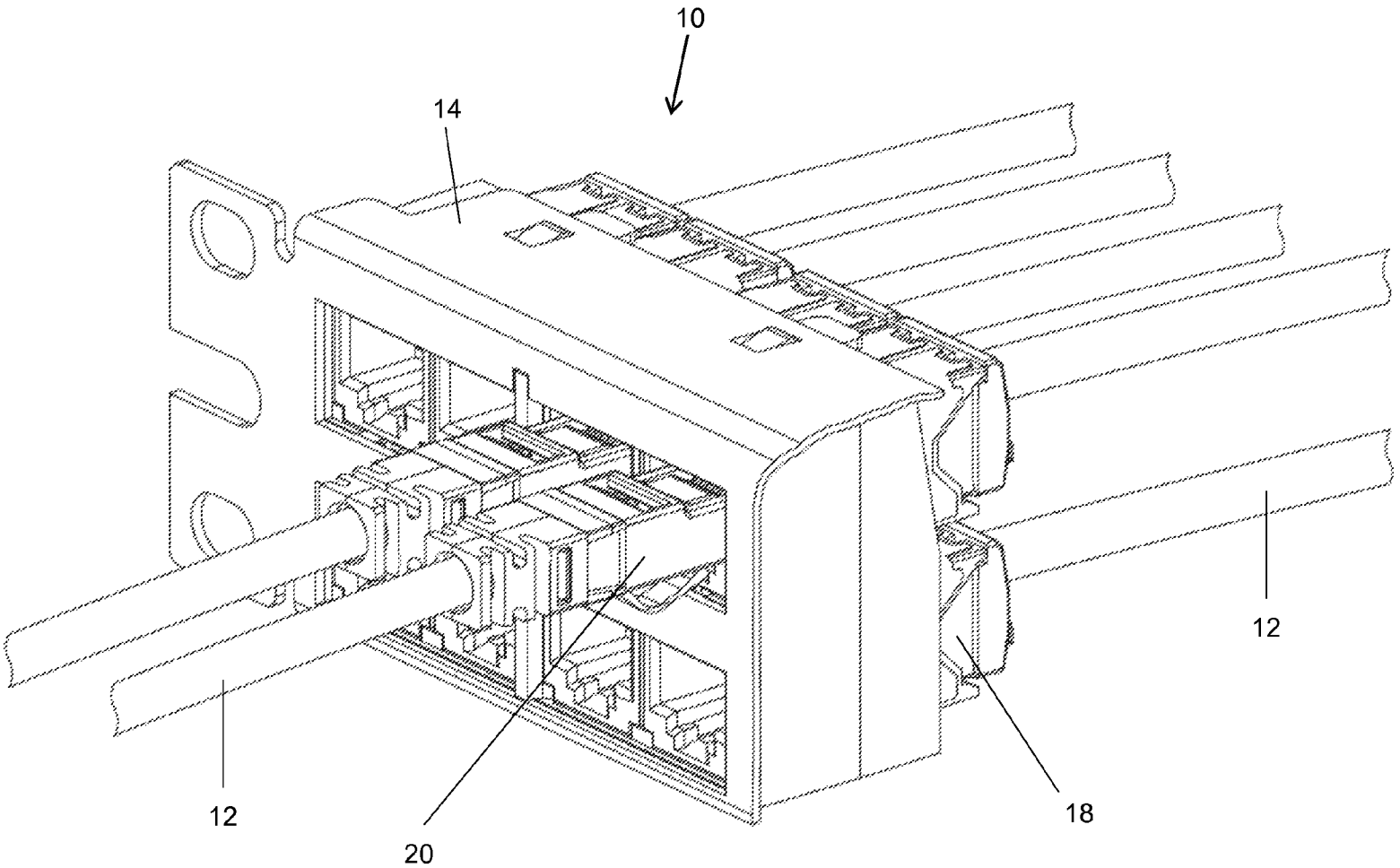
FIG. 1 illustrates a communication system according to an embodiment of the present invention.

An exemplary embodiment of the present invention is illustrated in FIG. 1, which shows a communication system 10, which includes a patch panel 14 with jacks 18 and corresponding RJ45 plugs 20. Respective cables 12 are terminated to plugs 20 and to jacks 18. Once a plug 20 mates with a jack 18 data can flow in both directions through these connectors. Although the communication system 10 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 10 can further include cabinets, racks, cable management and overhead routing systems, and other such equipment.

Although jacks 18 are shown as modular jacks, they can also be punch down or other types of jacks. Furthermore, the system 10 shown in FIG. 1 can be configured for CAT5E, CAT6, CAT6A, CAT7, CAT7A, CAT8 or other category communication system standard by the appropriate selection of applicable standard compliant plugs, jacks, cable and equipment.

Figure 2:
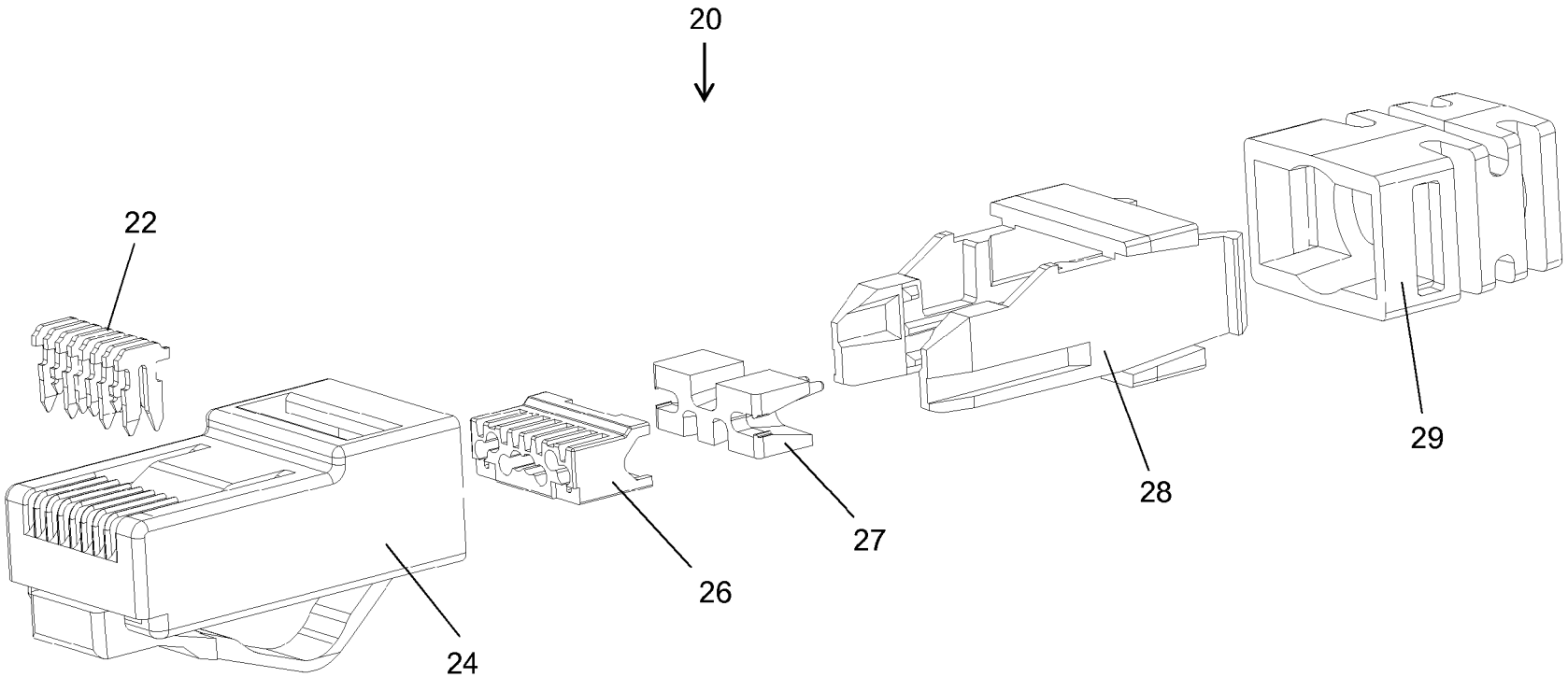
FIG. 2 illustrates an exploded view of a communication plug according to an embodiment of the present invention.

A more detailed view of the exemplary plug 20 is shown in FIG. 2. The plug 20 includes plug contacts 22, a plug housing 24, a load bar 26, a conductor divider 27, a strain relief collar 28, and a boot 29. Note that the load bar 26, conductor divider 27, strain relief collar 28, and boot 29 are optional components and can be the same or similar to those described in U.S. Pat. No. 6,811,445 to Caveney et al., entitled "Modular Cable Termination Plug," and incorporated herein by reference in its entirety. In other embodiments, the present invention can be implemented in a communication plug disclosed in U.S. Pat. No. 5,727,962 to Caveney et al., entitled "Modular Plug Connector" and U.S. Pat. No. 8,702,444 to Maranto et al., entitled "Communication Plug With Improved Cable Manager," both incorporated herein by reference in their entirety.

Figure 3:
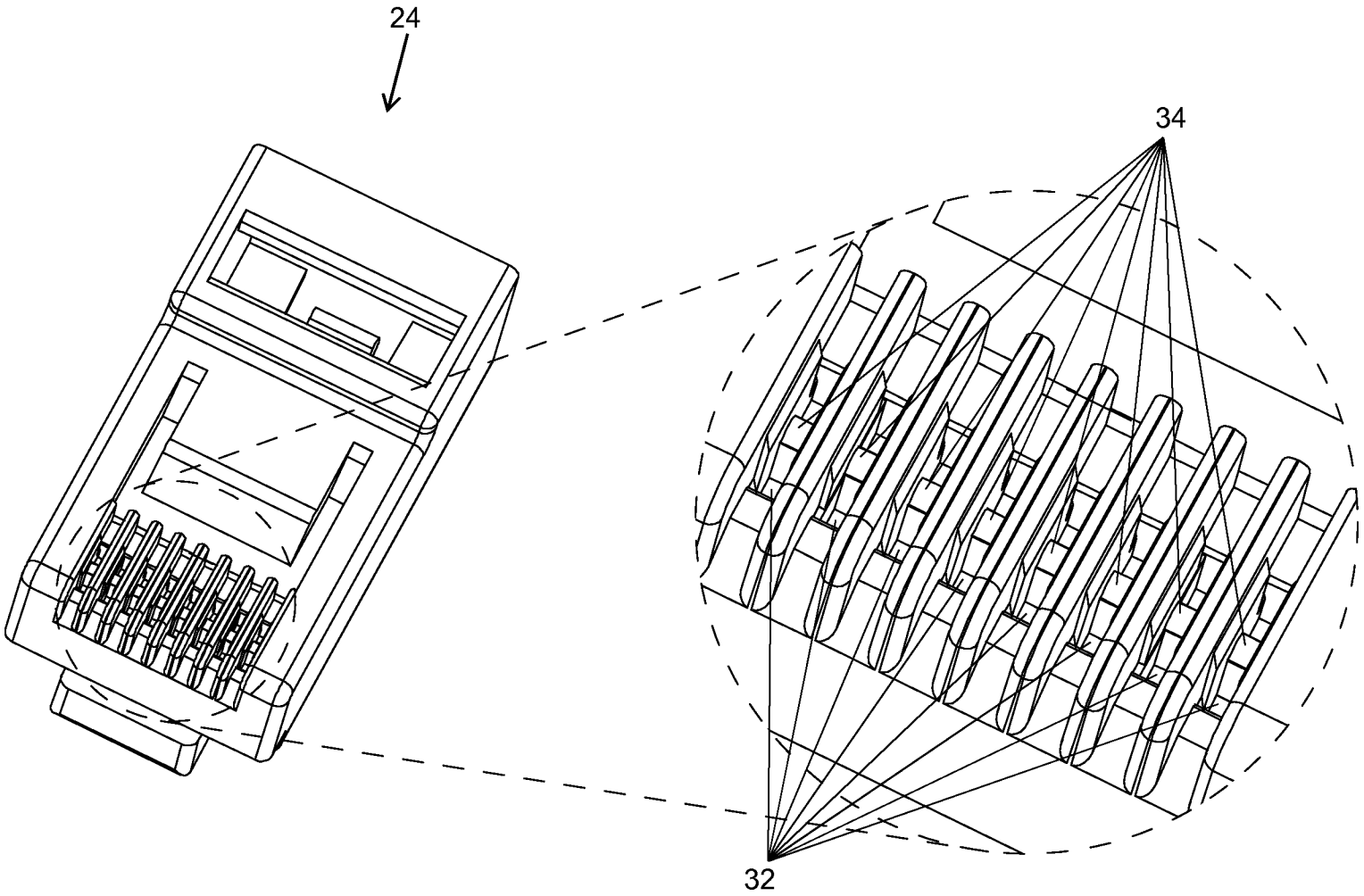
FIG. 3 illustrates a plug housing of the plug of FIG. 2, with detail.

The plug housing 24 can include eight vertical slots 32, as shown in FIG. 3, configured to receive eight plug IPCs 22. Alternate embodiments may have more or less slots 32. Slots 32 include a support element, such as horizontal bridge 34, positioned at least partially therein. Preferably, each the bridge 34 is positioned in the center of a respective slot 32 and below the outer surface of the plug housing 24.

Figure 4:
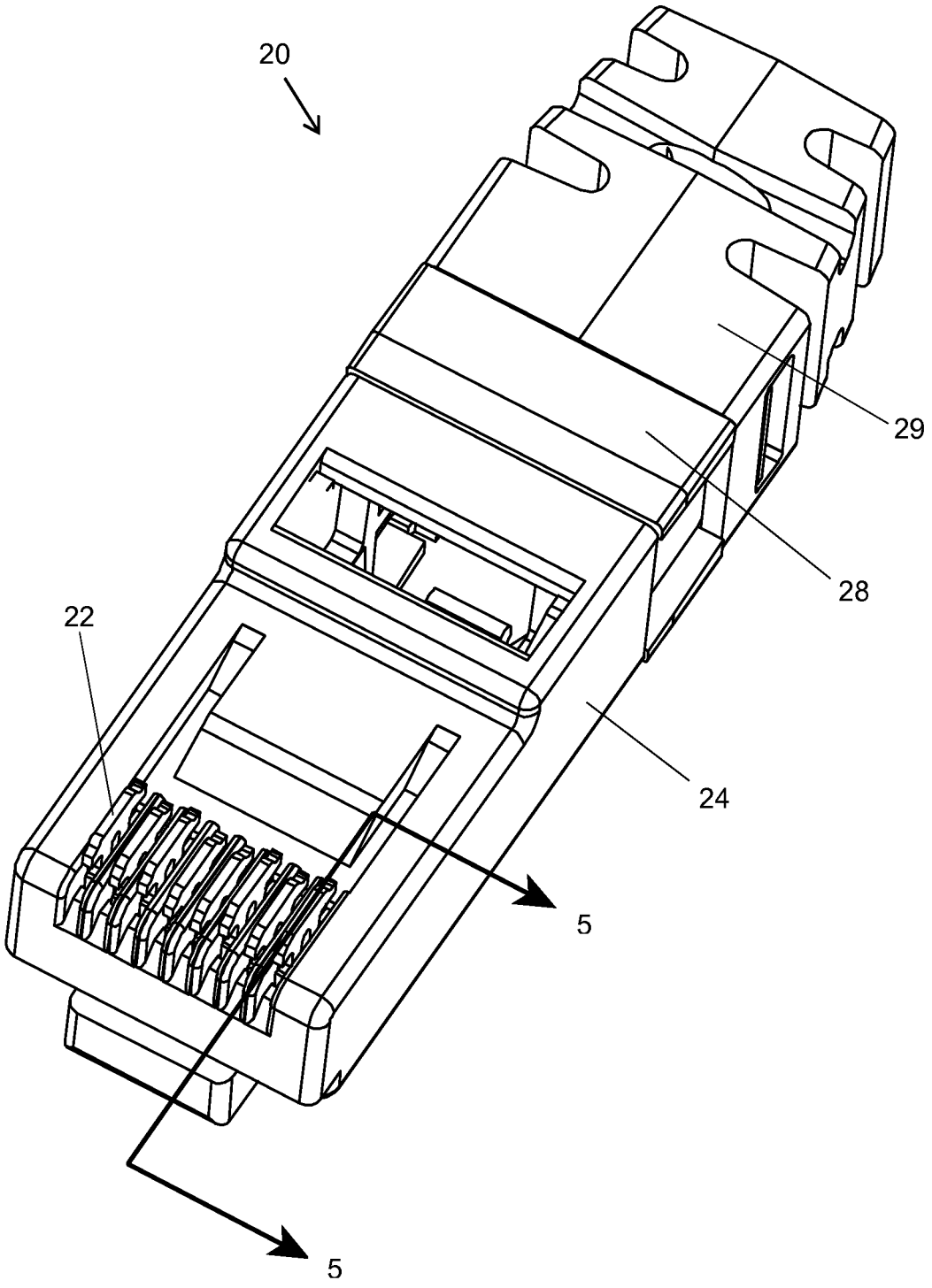
FIG. 4 illustrates the plug of FIG. 2 in an un-terminated state.
Figure 5:
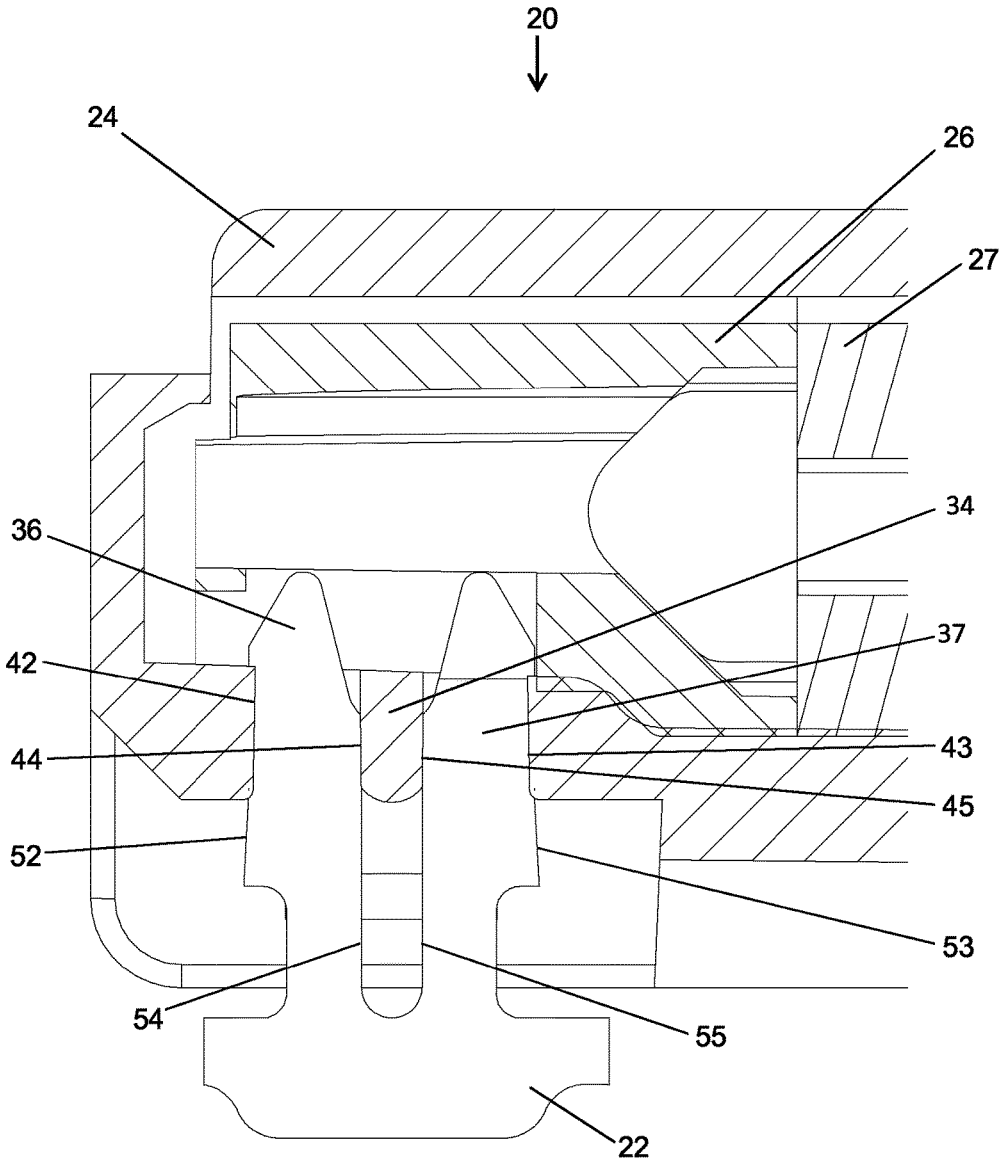
FIG. 5 illustrates a cross-sectional view, taken along section line 5-5 of FIG. 4, of a portion of the plug shown in FIG. 4.

Bridges 34 can serve multiple purposes. For example, bridges 34 can help retain plug contacts within the plug housing 24 in their un-terminated state. FIG. 4 shows the plug 20 in its un-terminated state with the plug contacts 22 not yet terminated to the conductors of the communication cable. A more detailed cross-sectional view of the plug contacts 22 as they are seated within the plug housing 24 is shown in FIG. 5.

This figure shows one of the eight IPC slots 32 with the bridge 34, and the position of plug contact tines 36 and 37 (which are parts of the slotted plug contacts 22) in the un-terminated position. Slotted plug contacts 22 are retained in the plug housing 24 due to the frictional interference therebetween. In particular, when the plug contacts 22 are installed into their un-terminated state, there is press fit contact between the surfaces 42 and 43 (of the plug housing 24) and surfaces 52 and 53 (of the tines 36 and 37, respectively) of the slotted contact 22. Similarly, there is also press fit contact between the surfaces 44 and 45 (of the bridge 34) and the surfaces 54 and 55 (of the tines 36 and 37, respectively) of the slotted contact 22. The bridge 34 acts as a spacer for the slot created by the tines 36 and 37. This helps prevent unwanted collapse of tines 36 and 37 towards each other, thereby retaining the press fit contacts between the various surfaces of the tines and the plug housing.

Figure 6:
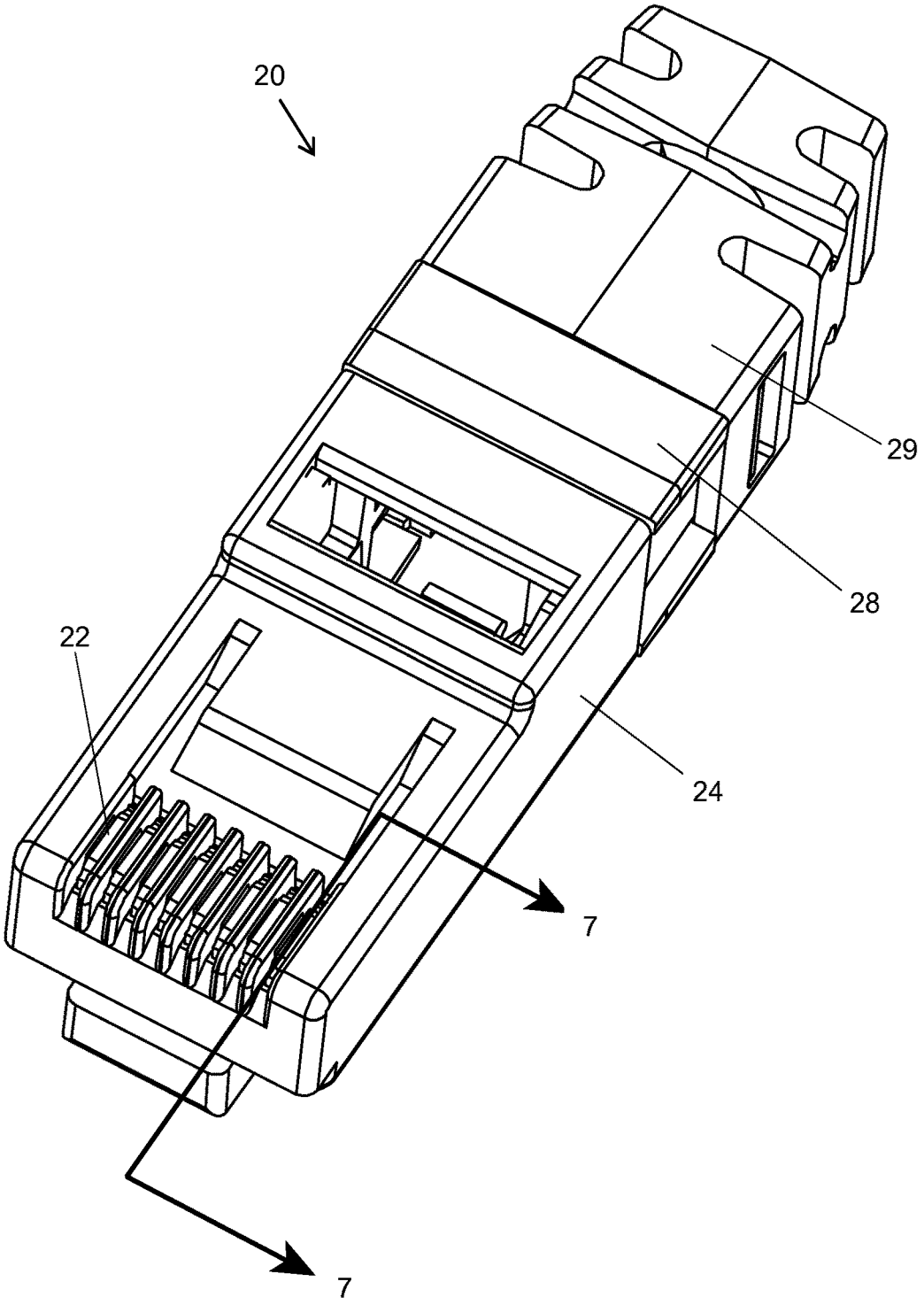
FIG. 6 illustrates the plug of FIG. 2 in a terminated state.
Figure 7:
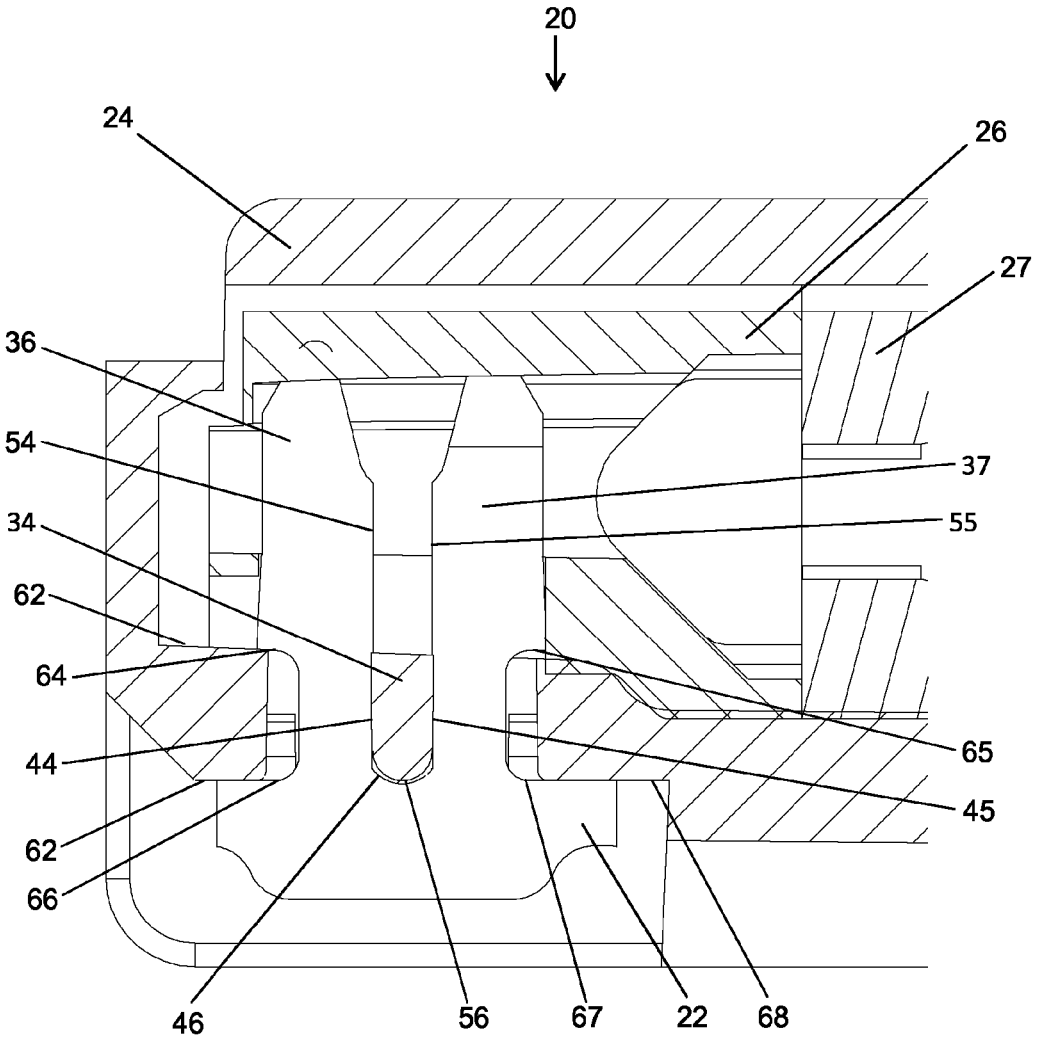
FIG. 7 illustrates a cross-sectional view, taken along section line 7-7 of FIG. 6, of a portion of the plug shown in FIG. 6.

Another benefit of the bridge features 34 is evident during plug termination. FIG. 6 shows the plug 20 in its terminated state and cable conductors omitted from the view, and FIG. 7 shows a cross-sectional view of one of the eight IPC slots 32 with the bridge 34, and the position of plug contact tines 36 and 37 in the terminated position.

The plug contacts 22 are press fit over the bridge feature 34 causing the surfaces 44 and 45 of the bridge 34 to press fit contact surfaces 54 and 55 of the IPC tines 36 and 37, respectively. As described previously, the bridge 34 acts as a spacer between the two tines of the IPC, preventing the likelihood of their collapse during termination. Furthermore, since the bridge 34 helps retain the tines in their non-collapsed form, tine surfaces 64, 65, 66, and 67 can retain press fit contact with plug housing surfaces 62 and 68. The overall frictional interference between the plug housing 24 and the plug contacts 22 helps retain plug contacts 22 in their appropriate terminated position.

In addition, bridge 24 can help guide and retain plug contacts 22 to and in their appropriate terminated position. In particular, surface 46 of the bridge 34 can prevent contact 22 from being forced too far into the plug housing 24 by making contact with the surface 56 of the plug contact 22 and acting as a stop for said plug contact. This can help prevent or reduce the earlier-noted problems associated with increased crimping force exerted during plug termination.

Figure 8:
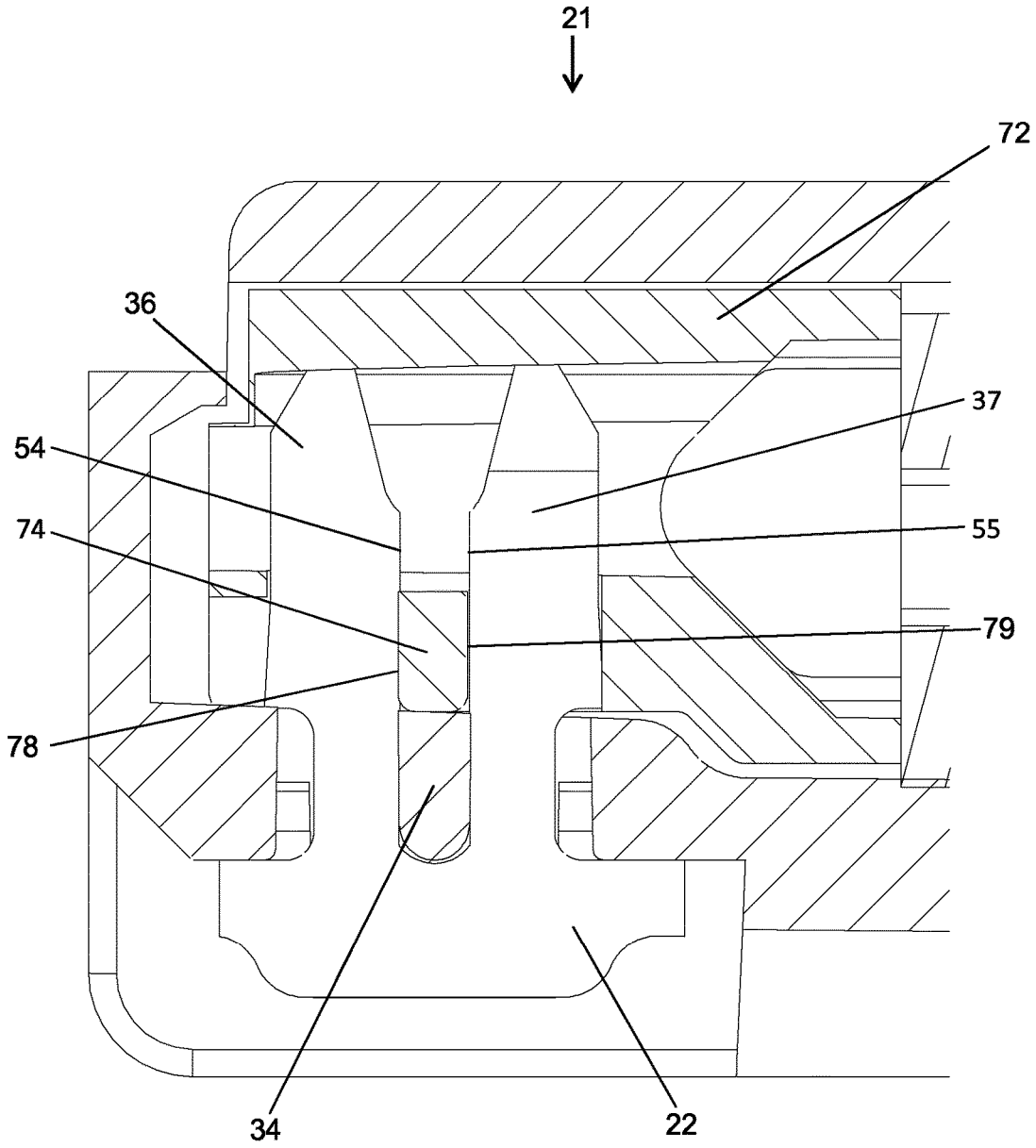
FIG. 8 illustrates a cross-sectional view of a portion of a terminated plug according to another embodiment of the present invention.

An alternate embodiment of a plug 21 in accordance with the present invention is shown in FIG. 8. FIG. 8 is similar to FIG. 7, in that it is a cross-sectional view of one of the eight IPC slots 32 with the bridge 34, and the position of plug contact tines 36 and 37 in the terminated position. However, the embodiment of FIG. 8 also includes a load bar 72 with a support element such as bridge feature 74. The functionality of bridge 74 is similar to that of bridge 34 in that it can help improve the retention of the slotted contact 22 and also provide additional protection against the collapse of tines 36 and 37 during the termination process. This is achieved by the added press fit contact between the surfaces 78 and 79 of the load bar bridge feature 74 and surfaces 54 and 55 of the tines 36 and 37, respectively.

Figure 9:
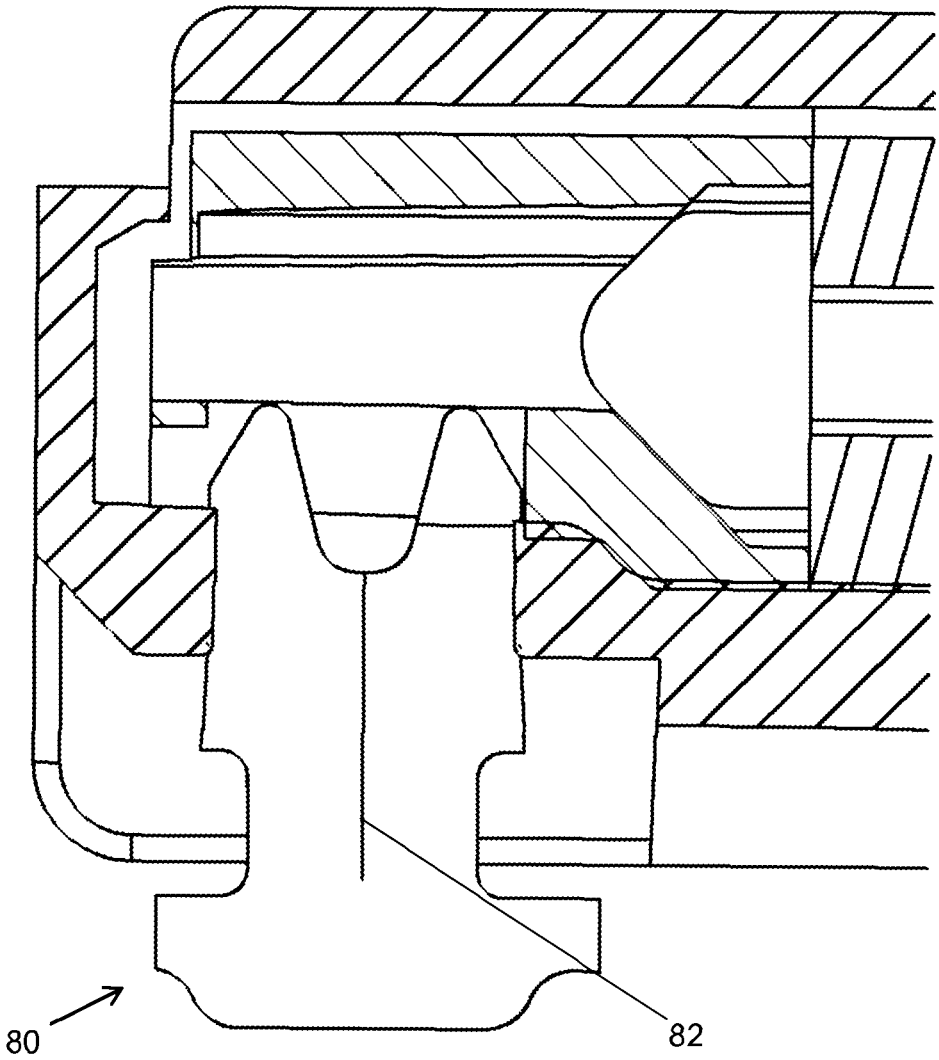
FIG. 9 illustrates a fragmentary cross-sectional view of a plug according to another embodiment of the present invention.
Figure 10:
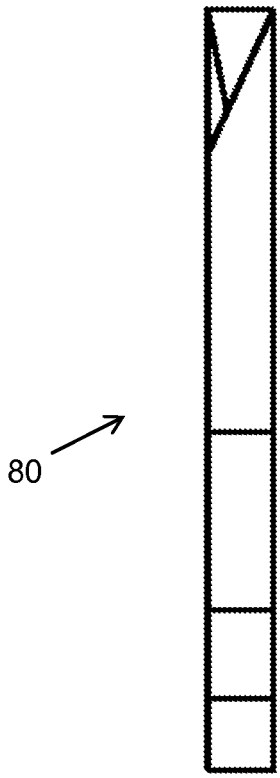
FIG. 10 illustrates a side view of the IPC of FIG. 9.

Referring now to FIG. 9, which is a cross-sectional view similar to FIGS. 7 and 8, showing a plug employing IPC 80 in another embodiment according to the present invention where IPC 80 includes a shear or laser cut 82 which takes away no material, or a minimum amount of material, so that the tines have sufficient strength and/or there is sufficient material which prevents the tines from collapsing and falling out of the plug housing prior to termination. The close proximity of the edges of cut 82 provide the support element in this embodiment. Other methods for producing cut 82 include wire electric discharge machining (EDM), electrochemical machining (ECM), and water jet cutting, or similar methods designed, at least in part, to minimize material removal. FIG. 10 is a side view of IPC 80 how the two sheared faces of cut 82 are in the same plane. IPCs 22, 84 and 90 can have a similar side view as is shown in FIG. 10. The tips of the tines can have a flat landing, and such landing may be in the 0.001-0.002 inch range; or the tips may be pointed, radiused or otherwise configured.

Figure 11:
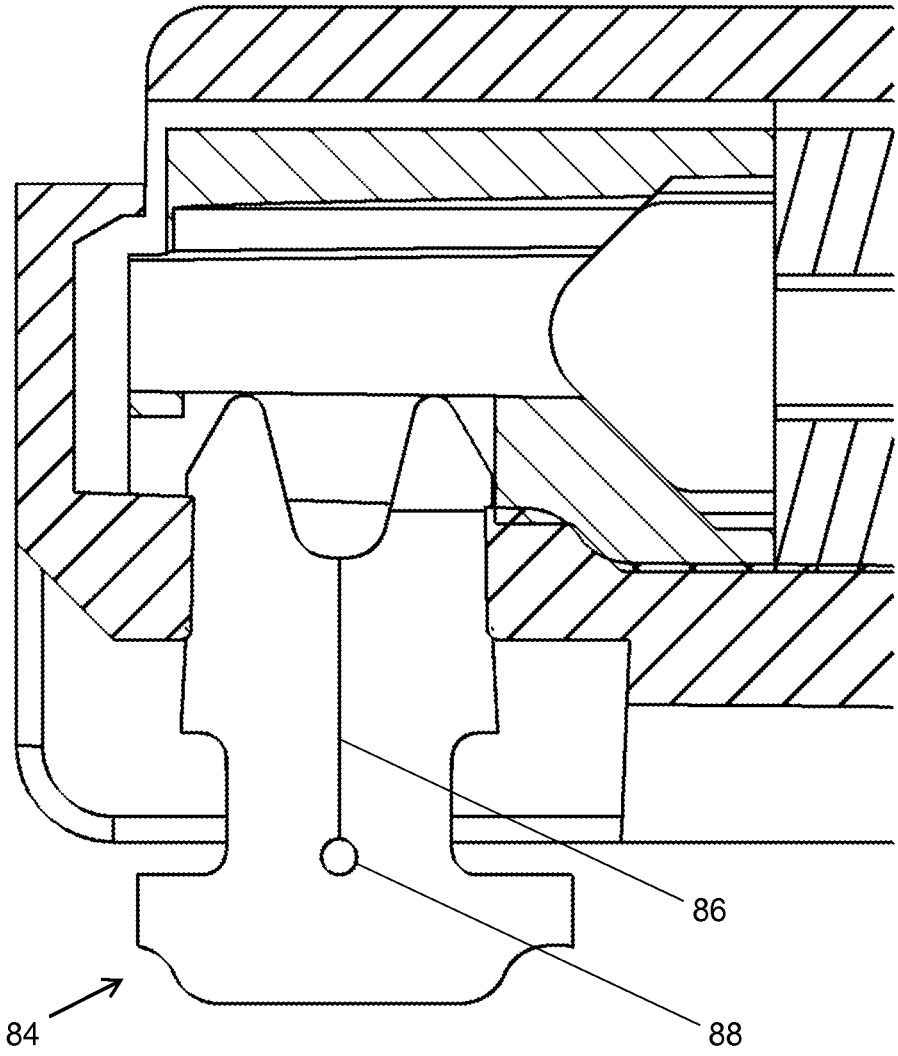
FIG. 11 illustrates a fragmentary cross-sectional view of a plug according to another embodiment of the present invention.

In another embodiment according to the present invention (see FIG. 11, which is a cross-sectional view similar to FIGS. 7 and 8) a plug employing IPC 84 includes cut 86 and relief hole 88. Relief hole 88 can be a punched, or other, hole which provides cut depth control and is a manufacturing aid to help guarantee uniform length of cut 86.

Figure 12:
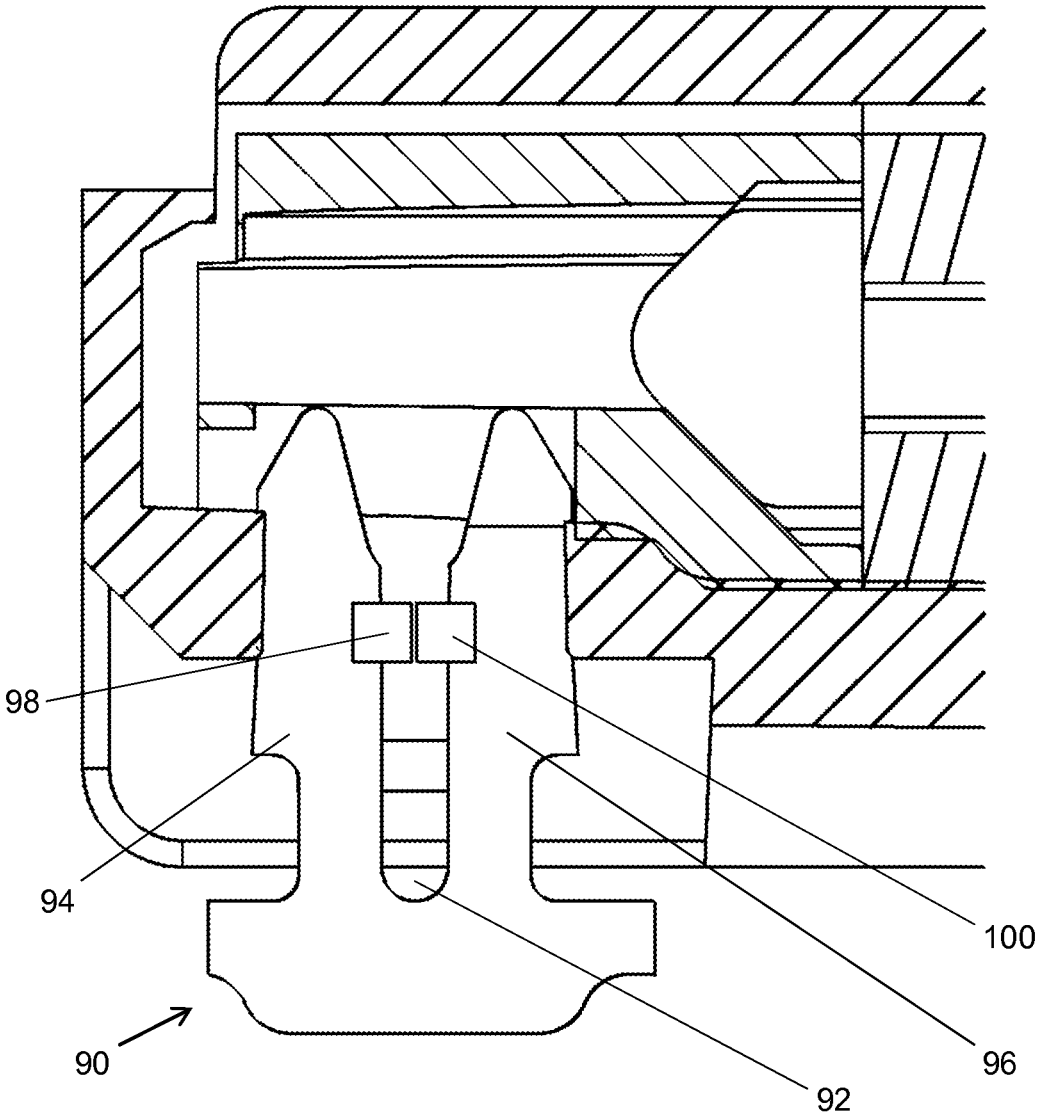
FIG. 12 illustrates a fragmentary cross-sectional view of a plug according to another embodiment of the present invention.

Referring now to FIG. 12, which is a cross-sectional view similar to FIGS. 7 and 8, shows a plug employing IPC 90 in another embodiment according to the present invention where IPC 90 includes slot 92 between the two tines 94, 96, and at least one of tines 94, 96 include a support element in the form of coined surfaces 98, 100, respectively. Coined surfaces 98, 100 can be formed using a coining operation which is a form of precision stamping in which a work piece is subjected to a sufficiently high stress to induce plastic flow on the surface of the material.

While this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. Moreover, any methods described or claimed, or that may be claimed should not be limited to any specific sequence of steps, and instead should be understood to encompass any sequence if such a sequence is allowable. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A communication plug comprising:

a plug housing including a plurality of plug contact slots;

at least one plug contact including a first tine with a first surface and a second tine with a second surface, said first surface and said second surface facing each other and further being parallel to each other, each of said at least one plug contact positioned in one of said plug contact slots; and a support element positioned between said first tine and said second tine.

2. The communication plug of claim 1, wherein said support element includes a bridge positioned between said first tine and said second tine.

3. The communication plug of claim 2, wherein one of said plug contact slots includes said bridge positioned between said first tine and said second tine such that said first surface abuts said bridge along a first side and said second surface abuts said bridge along a second side.

4. A communication system comprising:

communication equipment; and a patch cord connected to said communication equipment, said patch cord including a communication cable connected to a communication plug, said communication plug including a plug housing having a plurality of plug contact slots, at least one plug contact including a first tine with a first surface and a second tine with a second surface, said first surface and said second surface facing each other and further being parallel to each other, each of said at least one plug contact positioned in one of said plug contact slots, and a support element positioned between said first tine and said second tine.

5. A method of terminating a communication plug to a communication cable having signal conductors, said method comprising the steps of:

providing a plug housing with conductor channels for receiving said signal conductors, said plug housing having plug contact slots with a bridge for receiving plug contacts;

providing said plug contacts with insulation piercing contacts for making contact with said signal conductors, said plug contacts having a first tine with a first surface and a second tine with a second surface, said first surface and said second surface facing each other and further being parallel to each other;

positioning said plug contacts in respective said plug contact slots so that said bridge is positioned between said first tine and said second tine such that said first surface abuts said bridge along a first side and said second surface abuts said bridge along a second side; and crimping said plug contacts to achieve electrical contact between said insulation piercing contacts and respective signal conductors.

6. A method for manufacturing a communication plug, said method comprising the steps of:

providing a plug housing having a plurality of plug contact slots, each of said plug contact slots having a bridge; and partially inserting a plug contact having a first tine with a first surface and a second tine with a second surface, said first surface and said second surface facing each other and further being parallel to each other, into each of said plurality of plug contact slots such that said bridge is positioned between said first tine and said second tine such that said first surface abuts said bridge along a first side and said second surface abuts said bridge along a second side.

7. A communication plug comprising:

a plurality of plug contacts where each of said plug contacts including a first tine with a first surface and a second tine with a second surface, said first surface and said second surface facing each other and further being parallel to each other; and a plug housing having a plurality of plug contact slots, each of said plug contacts positioned in one of said plug contact slots, said plug housing further including a support element positioned between said first tine and said second tine.

* * * * *